United States Patent [19]

Roccaforte

[11] 4,361,270

[45] Nov. 30, 1982

[54] DOUBLE CELL, DOUBLE SLIDE DISPENSING CARTON AND CARTON BLANK FOR FORMING SAME

[75] Inventor: Harry I. Roccaforte, Western Springs, Ill.

[73] Assignee: Champion International Corporation, Stamford, Conn.

[21] Appl. No.: 276,797

[22] Filed: Jun. 24, 1981

[51] Int. Cl.[3] ..... B65D 5/72

[52] U.S. Cl. ..... 229/17 SC; 229/7 SC

[58] Field of Search ..... 229/7 SC, 17 SC, 27; 221/91, 86, 87, 124, 305, 306; 222/144.5

[56] References Cited

U.S. PATENT DOCUMENTS

| | | | |
|---|---|---|---|
| 2,983,421 | 5/1961 | Turpin | 229/17 R |
| 4,094,456 | 6/1978 | Roccaforte | 229/17 SC |
| 4,138,016 | 2/1979 | Roccaforte | 229/17 SC |
| 4,201,329 | 5/1980 | Roccaforte | 229/17 SC |

*Primary Examiner*—Herbert F. Ross

*Attorney, Agent, or Firm*—Evelyn M. Sommer

[57] ABSTRACT

A dispensing carton particularly adapted for use with small candies includes a pair of parallel tubular compartments which are closed at one end, while the upper end of the carton includes a pair of independently operable sliding tabs which are disposed intermediate overlapping cover flaps. The upper closure of the carton includes two sets of registered openings, each set of openings registering with one of the compartments. Each sliding tab is hingedly connected to a pivotally connected top portion of an end wall. The sliding tabs may be individually moved to positions such that both compartments are open, or one compartment is open while the other compartment is closed, or where both compartments are closed.

9 Claims, 5 Drawing Figures

DOUBLE CELL, DOUBLE SLIDE DISPENSING CARTON AND CARTON BLANK FOR FORMING SAME

BACKGROUND OF THE INVENTION

The present invention relates to a new and improved closable dispensing carton adapted for use with two different, small candies or the like. More particularly, it relates to a reclosable dispensing carton having two compartments and capable of dispensing a plurality of items through two different dispensing openings by operation of independent, slidable dispensing tabs. The subject carton is an improvement over the inventions disclosed in U.S. Pat. No. 4,094,456, which issued to Harry I. Roccaforte, on June 13, 1978, entitled RECLOSABLE DISPENSING CARTON, and U.S. Pat. No. 4,201,329, which issued to Harry I. Roccaforte on May 6, 1980, entitled DOUBLE CELL SLIDE DISPENSER, both of which patents are assigned to the same assignee as the present invention.

Reclosable cartons for dispensing small articles such as candies or pills, have been previously manufactured out of plastic materials. Generally, the contents of such cartons are dispensed by raising a pivoting section of the lid which can be lifted to open the carton and then pressed back into position to reclose the carton. The use of plastic materials in the manufacture of such articles is costly. Further, the non-biodegradable nature of plastic materials generally renders their use environmentally unsound.

The invention disclosed in U.S. Pat. No. 4,094,456 provides a paperboard carton blank and a paper dispensing carton in the form of a single tubular enclosure. One end of the carton includes an overlapping arrangement of tabs, the upper and lowermost tabs having registered openings therein. An intermediate closure tab is slidably mounted between said overlapping tabs. The slidable closure tab is operative to uncover the registered openings to enable the dispensing of the contents from the carton, after which the closure tab may be slidably moved to a position so as to cover the registered opening for reclosing the carton. The invention of U.S. Pat. No. 4,094,456 thus provides a paper reclosable dispensing carton for dispensing a single lot of small articles.

A reclosable paper carton adapted for dispensing small articles and having more than one compartment to enable different materials to be marketed in the same carton is disclosed in U.S. Pat. No. 4,201,329. The latter provides a tubular paper carton having a plurality of compartments defined by an internal partition wall. Instead of a single set of registering openings, there is a pair of sets of registering openings, each set being aligned with one of the two compartments within the container. A single dispensing opening in a single slide tab is movable to uncover either desired set of registering openings to permit dispensing from that particular compartment of the carton while simultaneously preventing dispensing from the other compartment. The entire tab structure may be moved to a closed position whereby neither of the sets of registered dispensing openings is available for passage of articles or materials therethrough. The invention of U.S. Pat. No. 4,201,329 thus provides a reclosable paper carton capable of dispensing different small articles alternately from one compartment at a time.

Accordingly, it is an object of the present invention to provide an elongated tubular carton which is compartmented and has a closure structure which provides independently operable sliding tabs, one for each compartment, so that materials within each compartment may be dispensed either separately or both at the same time.

It is another object of the subject invention to provide a new and improved elongated tubular carton which is compartmented and which has an end wall structure of double thickness to enhance the structural rigidity and durability of the carton.

It is a further object of the subject invention to provide a new and improved elongated tubular paperboard carton which is compartmented and has two end walls, each structure of which includes an inner panel and an outer panel, with each inner panel effectively preventing the escape of any contained materials from the carton, except through the dispensing openings provided in the top closure structure of the carton.

SUMMARY OF THE INVENTION

The subject invention is a new and improved reclosable dispensing carton adapted for use with small candies, and a carton blank for forming the dispensing carton. The carton is of an elongated tubular design having a generally rectangular cross section and is longitudinally partitioned to form two discrete compartments. The bottom portion of the carton is closed, while at the upper portion an arrangement of overlapping flaps and tabs is provided. The uppermost and lowermost flaps have two sets of registering openings, with each set of openings being aligned with a respective one of the compartments within the carton. A pair of intermediate closure tabs are slidably mounted between the overlapping flaps and each closure tab is independently movable to uncover a single set of adjacent openings. Both of the closure tabs may be moved to an opened position for the simultaneous dispensing of materials from both compartments. The tabs may also be individually operated so that one tab may be in an open position while the other tab is in a closed position such that materials may be dispensed from only one compartment. Lastly, both tabs may be moved to their closed position so that no dispensing of the contained materials will occur.

Further objects and advantages of the subject invention will become apparent from the following detailed description in conjunction with the drawings in which:

DETAILED DESCRIPTION OF THE PREFERRED EMBODIMENT

Figure 1:
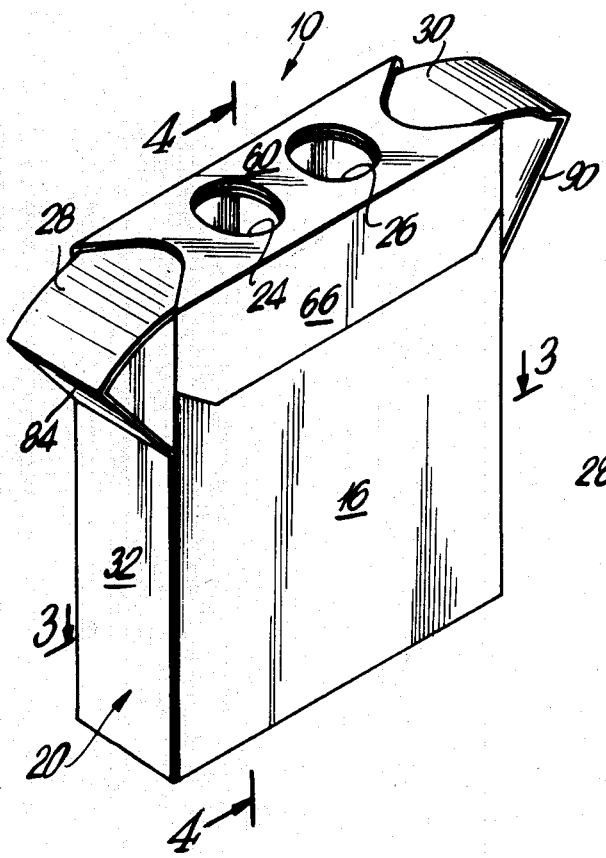
FIG. 1 is a perspective view of the new and improved reclosable dispensing carton of the subject invention, with both closure tabs being in the operative position to enable the simultaneous dispensing of the contents from both compartments of the carton.

Referring to FIG. 1, the reclosable dispensing carton of the subject invention is generally designated by the numeral 10. Carton 10 is an elongated tubular structure having a generally rectangular cross section and including a closed bottom 12 and a top closure portion 14 which may be partially or fully opened for dispensing the contents of the carton and reclosed for storage purposes, as more fully described hereinafter.

Figure 5:
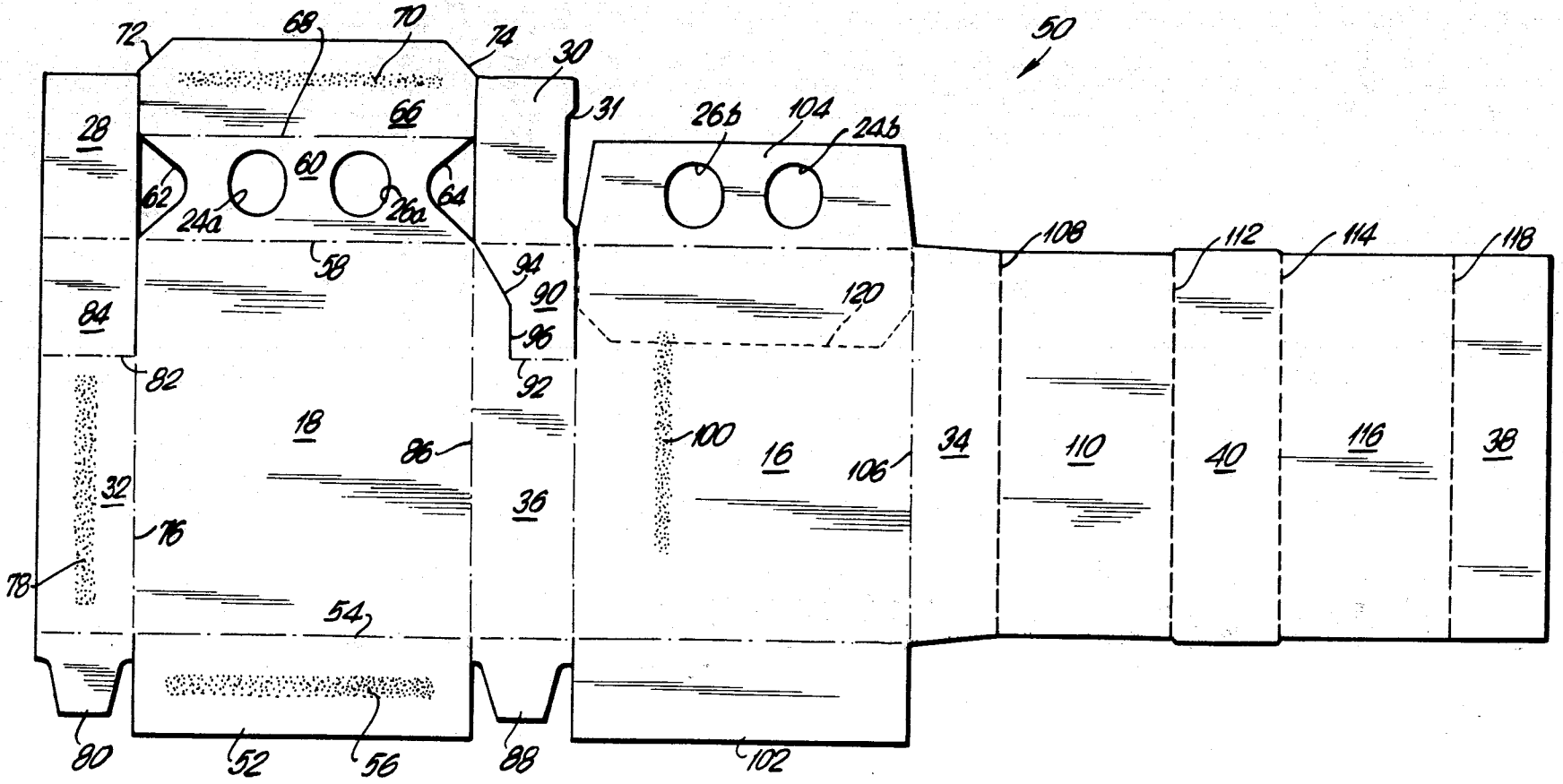
FIG. 5 is a plan view of the new and improved blank of the subject invention.

The carton 10 as shown in its fully erected position in FIG. 1 is preferably formed of a single paperboard sheet of a carton blank as shown in FIG. 5. Carton 10 includes a front side wall 16 and a rear side wall 18 which are alternately and hingedly connected to a first end wall 20 and a second end wall 22.

The top closure portion 14 of carton 10 includes reclosable registering openings 24 and 26 which are covered by two slidably mounted closure tabs 28 and 30 respectively. The two closure tabs 28 and 30 may have four relative positions comprising the situation in which opening 24 is open, or a second position where opening 26 alone is open. In a third position both openings 24 and 26 are open while in a fourth position neither of the openings 24 or 26 is open.

Figure 2:
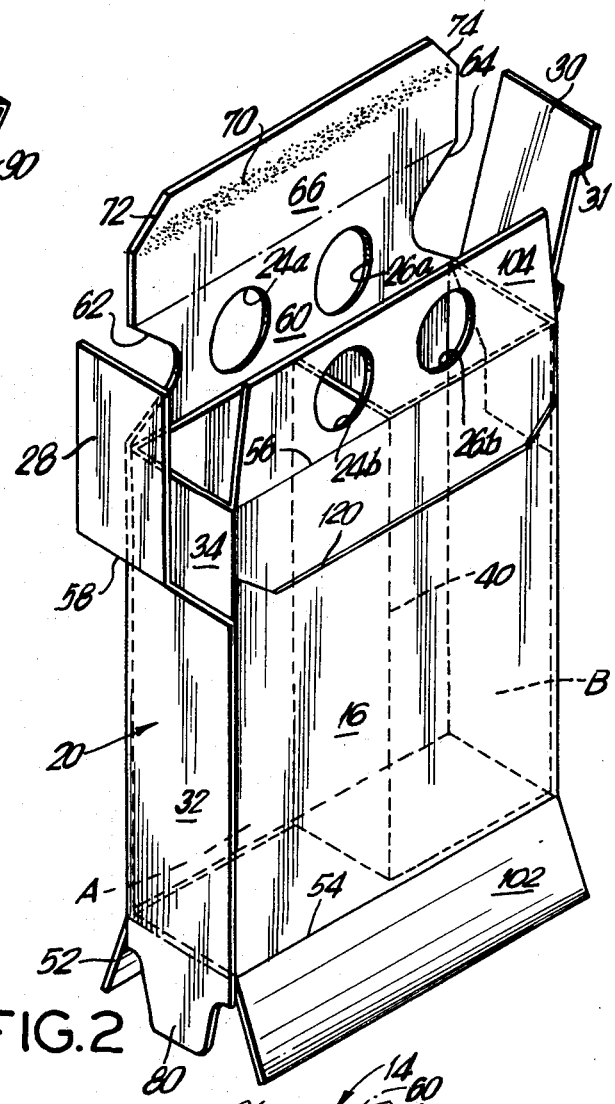
FIG. 2 is a perspective view of the partially erected carton.
Figure 3:
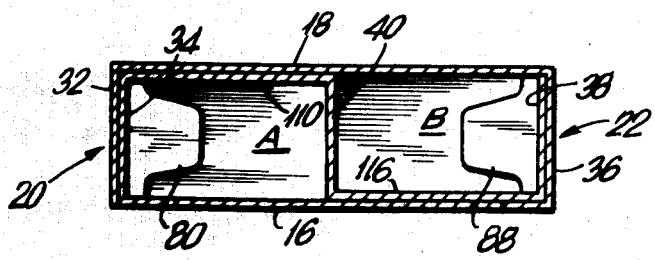
FIG. 3 is a cross-sectional view taken along line 3—3 in FIG. 1.

The carton end walls 20 and 22 are preferably of double thickness, with the first end wall 20 including an outer panel 32 and an inner panel 34. The second end wall 22 likewise includes an outer panel 36 and an inner panel 38 as shown in FIGS. 2 and 3. Carton 10 is also provided with a central internal partition 40 which divides the interior of carton 10 into two compartments, hereinafter referred to as compartment A and compartment B.

As mentioned above, the reclosable carton 10 is preferably formed from a single sheet of carbon blank 50 made of paperboard material, as depicted in FIG. 5. The carton blank 50 includes a rear side wall panel 18 which has a flap 52 extending from the lower portion thereof and hingedly connected thereto along fold line 54. Flap 52 includes a strip of adhesive 56. Hingedly connected along fold line 58 to the upper portion of rear side wall panel is a closure flap 60 that includes a pair of spaced apertures **24*a* and 26*a* disposed intermediate its width. In addition, in the preferred embodiment, closure flap 60 further includes two V-shaped cut-aways 62 and 64 disposed at opposed ends thereof. Closure flap 60, in turn, is hingedly connected to frontal flap 66 along fold line 68. The frontal flap 66 has the strip of adhesive 70 extending along its width, and in a preferred embodiment flap 66 includes chamfered corners designated as 72 and 74**.

Hingedly connected to one side of rear side wall panel 18 is the outer panel 32 of the first end wall 20 along fold line 76. Outer panel 32 has a strip of adhesive 78 disposed intermediate its width and has a bottom tab 80 extending from and hingedly connected along fold line 54. At its upper end, outer panel 32 is pivotally connected along hinge line 82 to a flap portion 84 which, in turn, is pivotally connected along hinge line 58 to the closure tab 28.

Along its other side rear side wall panel 18 is hingedly connected along fold line 86 to outer panel 36 of the second end wall 22. At its lower end a bottom tab 88 extends from and is hingedly connected to outer panel 36 along fold line 54. At its top end, outer panel 36 is pivotally connected to a top flap 90 along hinge line 92. The top flap 90 is formed by angled cut line 94 that meets with vertical cut line 96 which extends parallel to fold line 86 and terminates at hinge line 58. The closure tab 30 having a cut out portion 31 is hingedly connected to top portion panel 90 along fold line 58.

Outer panel 36 of the second end wall 22 is hingedly connected to a front side wall panel 16 about fold line 98. Front side wall 16 includes a strip of adhesive 100 disposed intermediate its width, and has a bottom panel 102 extending from the lower portion thereof and is hingedly connected thereto about fold line 54. Hingedly connected along fold line 58 to the upper portion of front side wall panel 16 is a closure flap 104 having two spaced apertures **24*b* and 26*b***.

Forming a portion of the blank 50 are the hingedly connected panels for defining the central partition 46 and the reinforcing end wall panels 34 and 38. More particularly, end wall panel 34 is hingedly connected to front panel 16 along hinge line 106, and along hinge line 108 to rear reinforcing panel 110. In turn, the latter is hingedly connected to central partition 40 along hinge line 112, while front reinforcing panel 116 is respectively hingedly connected to partition 40 and end wall panel 38 along hinge lines 114 and 118.

The preferred method of folding of the carton blank 50 for erection of the carton involves first placing the panel 38 (which will form the inner panel of the second end wall 22) so that it overlays and is coplanar with outer panel 36 whereby fold line 118 coincides with fold line 98. Panel 116 is next placed to partially overlie front side wall panel 16 and is bonded thereto by means of adhesive strip 100. Panel 34 which will form the inner panel of the first end wall 20 is then folded to a position normal to the front side wall panel 16 along line 106. Front side wall 16 is then folded normal to outer panel 36 of the second end wall 22 along fold line 98 and outer panel 36 is folded normal to rear side wall panel 18 along line 86. Outer panel 32 is then folded normal to rear side wall panel 18 about line 76, and is bonded to inner panel 34 of the first end wall 22 by means of the adhesive strip 78.

Figure 4:
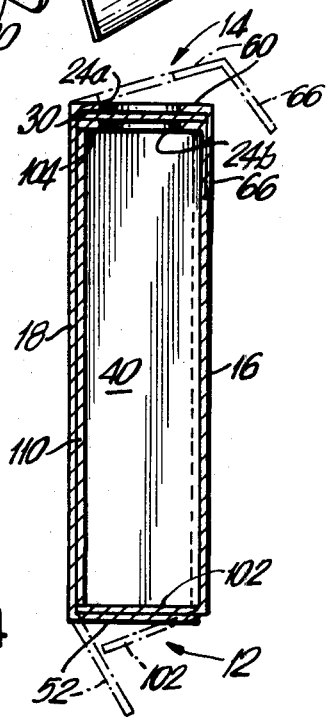
FIG. 4 is a cross sectional view taken along line 4—4 in FIG. 1.

When the carton blank is folded in this manner a partially erected carton is formed as shown in FIGS. 2, 3, and 4. An elongated rectangular tubular enclosure is defined wherein front side wall 16 is opposed to rear side wall 18, and is alternately hingedly connected to rear side wall 18 by a first end wall 20 comprised of inner panel 34 and outer panel 32, and an opposed second end wall 22 which is comprised of inner panel 38 and outer panel 36. The central partition panel 40 extends between front side wall 16 and rear side wall 18 thereby dividing the interior of carton 10 into discrete compartments designated A and B. The partition panel 40 is hingedly connected to inner panel 116 which overlies and is coplanar with the front side wall panel 16 to a point intermediate its width, and to inner panel 110 which overlies and is coplanar with rear side wall panel 18.

The bottom 12 of the carton may now be formed. As illustrated in the FIGS. 2, 3, 4, and 5, the bottom wall of carton 10 is formed by first folding tabs 80 and 88 inwardly, after which flat 102 is folded. Finally flap 52 is folded upwardly such that flap 52 is adhesively secured to the outer surface of flap 102 by means of adhesive strip 56, thereby completing the bottom 12 of the carton.

As shown in FIGS. 2 and 5, the top closure structure 14 is formed by first folding cover flap 104 downwardly to a position normal to a side wall 16. In that position of cover flap 104, the apertures 24b and 26b are respectively aligned with compartments A and B. Next, the closure tab 28 is folded downwardly normal to top flap 84 along fold line 58 for surface to surface engagement with the cover flap 104. Similarly, closure tab 30 is folded down normal to top flap 90 along fold line 58 for surface to surface engagement with cover flap 104. Closure tabs 28 and 30 extend to a length intermediate cover flap 104 sufficient to cover each of the respective apertures 24b and 26b adjacent thereto. It is noted that although the length of the closure tabs 28 and 30 are sufficient to cover the respective apertures neither tab is of a length to permit the closure tab to overlap the other closure tab, nor to cover both apertures. Next, the cover flap 60 is folded downwardly normal to the rear side wall panel 18 such that it overlies and is in surface to surface engagement with closure tabs 28 and 30. The frontal panel 66 is then folded normal to cover flap 60 so that it may be bonded to the outer surface of the front side wall panel 16 by means of the adhesive strip 70 thereby completing the erection of the carton. The cover flap 60 includes the pair of apertures 24a and 26a which are disposed to register with the above mentioned apertures 24b and 26b. In the preferred embodiment of the invention, the outer surface of front side panel 16 is depressed as at 120 in a configuration corresponding to the configuration of the frontal panel 66. Thus, in the erected condition of the carton 10, the front wall is flush with the frontal panel 66.

The erected disposable carton 10 is now ready for use. The separate compartments A and B may be filled with different candies, pills, etc., and the closure tabs 28 and 30 positioned in their retracted condition so as to respectively obstruct the registered openings 24 and 26. Actuation of closure tab 28 by sliding same outwardly to the position illustrated in FIG. 1 uncovers the aperture 24, thereby permitting the dispensing of contents from the compartment A. Closure tab 28 may then be actuated inwardly to a closed position so as to cover aperture 24, thereby sealing off compartment A.

Similarly, closure tab 30 may be independently actuated by sliding movement, outwardly so as to uncover the registered apertures 26a and 26b forming opening 26, thereby enabling the dispensing of the contents of compartment B. After dispensing, closure tab 30 may be actuated inwardly to cover the aperture 26 thereby sealing off compartment B.

On the other hand, both closure tabs 28 and 30 may be simultaneously actuated, by sliding outwardly as shown in FIG. 1, for the simultaneous dispensing of the contents of compartments A and B.

As shown in FIGS. 1, 2 and 5, the cover flap 60 includes two V-shaped cutouts 62 and 64 at its opposed ends. The cut outs 62 and 64 function to expose an end section of each closure tab 28, 30 so as to provide for easy thumb or finger engagement of the user, thereby enabling the user to readily slide the closure tabs 28 and 30 to their open and closed positions.

The double walled end structure of the subject carton prevents the escape of the carton's contents except from the dispensing openings defined by the registering apertures 24 and 26. More particularly, referring to closure tab 20, as shown in FIG. 1, when closure tab 28 is in the open position, top flap portion 84 is pivoted outwardly thereby in effect reducing the length of the end wall 20. Without the inner panel 34 extending to the full height of the carton 10 and meeting the top closure structure 14, the contents of compartment A could escape through the opening so formed. The double thickness end wall structure 20 provided by outer panel 32 and inner panel 34 thus forms a closed compartment A which can be opened only by means of slidable closure tab 28. The same is true of compartment B with its double thickness and end wall structure 22 provided by inner panel 38 and outer panel 36 with its closure tab 30.

As shown in FIGS. 2 and 5, in the preferred embodiment closure tab 30 includes a cut out section 31 that functions as a guide during the die cutting operations of manufacture of the carton blank 50. The special configuration given to the flap portion 90, and more particularly, the angled cut line 94–96, provides an added resistance to buckling or bending of the carton blank as it is being moved along in the manufacturing process. The cut out 31 and the special configuration of flap portion 90 further provides a distinguishing feature by means of which closure tabs 28 and 30 may be distinguished. Thus the user will always know that the end wall of the carton having a specially configured flap portion 90 will operate the closure tap 30 for opening compartment B thereby eliminating any confusion as to which closure tab is associated with each compartment.

The closure structure of the carton 10 of the subject invention may be operated by the thumb or forefinger of the user. The finger is engaged with a closure tab 28 or 30 at the respective V-shaped cut-outs 62 and 64. Each closure tab is then slidably withdrawn outwardly until a set of registered openings is uncovered. The structure of the new and improved dispensing carton of the subject invention provides a pair of closure tabs adapted to be slidably actuated to open and close the registered apertures leading to the compartments. The closure tabs 28 and 30 are independently operable so that the subject invention provides a carton from which the contents of the compartments may be dispensed either singularly or both at the same time.

While the subject invention has been described with reference to a preferred embodiment such reference has been made for purely illustrative purposes and various modifications could be devised without departing from the scope or spirit of the subject invention as defined by the appended claims.

What is claimed is:

1. A reclosable dispensing carton comprising:

an elongated tubular enclosure having a generally rectangular cross section including alternately, hingedly connected first and second opposed side walls and first and second opposed end walls, said end walls being defined by inner and outer coplanar panels;

a partition panel extending from said first side wall to said second side wall thereby dividing said carton into two discrete elongated tubular compartments;

a bottom closure sealing one end of said carton; and a top closure structure sealing the opposed end of said carton, said top closure structure including:

a first cover flap hingedly connected to the first side wall and disposed perpendicular thereto so as to cover the upper end of each said compartment, said first flap having a pair of spaced apertures, each of which is aligned with one of said compartments;

a second cover flap hingedly connected to said second side wall and including first and second hingedly connected sections, said first section being coplanar with and overlying said first cover flap and having a pair of apertures disposed in register with said apertures of said first flap, and with said second section of said second cover flap overlying and being adhesively bonded to said first wall; and a pair of closure tabs respectively hingedly connected to a flap portion of the outer panel of each said end wall, each said closure tab being slidably interposed between said first and second cover flaps and being of a length sufficient to cover the adjacent aperture in said first cover flap, said flap portion of each said outer panel being pivotally connected to the remaining portion of the outer panel of the end wall, whereby, the closure tabs may be independently slidably displaced outwardly to uncover the respective registered apertures so as to enable the contents within the compartments to be dispensed either from one compartment alone or from both compartments simultaneously.

2. A reclosable dispensing carton as recited in claim 1 wherein said first section of said second cover flap includes a plurality of V-shaped grooves disposed at each opposite end thereof.

3. A reclosable dispensing carton as recited in claim 1 wherein the portion of said first side wall to which the second section of said second cover flap is bonded is embossed in the carton blank.

4. A reclosable dispensing carton as recited in claim 1 wherein said second section of the second cover flap includes chamfered corners.

5. A reclosable dispensing carton as recited in claim 1 wherein the bottom closure includes a pair of tabs respectively hingedly connected to the bottom ends of each of the outer panels of said end walls, said tabs extending inwardly and perpendicularly to said end walls;

a first elongated tab extending from and hingedly connected to said second side wall and disposed perpendicular thereto so that said first elongated tab completely covers the bottom of the carton; and a second elongated tab extending from and hingedly connected to the first side wall, said second elongated tab being coplanar with and overlying said first elongated tab and adhesively bonded thereto.

6. A reclosable dispensing carton comprising:

an elongated tubular enclosure having a generally rectangular cross section including alternately, hingedly connected first and second opposed side walls and first and second opposed end walls, said second side wall including a depressed area adjacent the top of said second side wall, said end walls being defined by inner and outer coplanar panels;

a partition panel extending from said first side wall to said second side wall so as to divide said carton into two discrete elongated tubular compartments;

a bottom closure sealing one end of said carton; and a top closure structure sealing the opposed end of said carton, said top closure structure including:

a first cover flap hingedly connected to the first side wall and disposed perpendicular thereto so as to cover the upper end of each said compartment, said first flap having a pair of spaced apertures each of which is aligned with one of said compartments;

a second cover flap hingedly connected to said second side wall and including first and second hingedly connected sections, said first section being coplanar with and overlying said first cover flap and having a pair of apertures in register with said apertures of said first flap, said second cover flap having a V-shaped groove disposed at each of its opposed ends, and with said second section of said second cover flap being disposed in said depressed area and adhesively bonded to said first side wall; and a pair of closure tabs respectively hingedly connected to a top portion of the outer panel of each said end wall and slidably interposed between said first and second cover flaps, each said closure tab having a length sufficient to overlay the adjacent aperture in said first cover flap, said top portion of each said outer panel being pivotally connected to the remaining portion of the outer panel of the end wall, whereby, end closure tabs may be independently slidably displaced outwardly to uncover the respective registered apertures to enable the material in the compartments to be dispensed either from one compartment alone or from both compartments simultaneously.

7. A reclosable dispensing carton as recited in claim 6 wherein said carton is formed from a single sheet of paperboard material.

8. A reclosable dispensing carton as recited in claim 6 wherein the bottom closure includes a pair of tabs respectively hingedly connected to the bottom ends of each of the outer panels of said end walls, said tabs extending inwardly and perpendicular to said end walls;

a first elongated tab extending from and hingedly connected to said second side wall and disposed perpendicular thereto so that said first elongated tab completely covers the bottom of the carton; and a second elongated tab extending from and hingedly connected to the first side wall, said second elongated tab being coplanar with and overlying said first elongated tab and adhesively bonded thereto.

9. A carton blank for a dispensing carton having a discrete pair of compartments which includes a pair of independently slidably mounted valve openings at the top thereof and also a closed bottom, said blank comprising, in turn, a first outer end panel having a tab extending from the bottom portion thereof, a top portion pivotally connected to said outer panel of said end wall and a closure tab hingedly connected to said top portion of the outer panel of the first end wall;

a first side wall panel having a flap extending from the bottom portion thereof, and an elongated first cover flap extending from the top thereof, said first cover flap including first and second hingedly connected section panels, said first section panel of said first cover flap including a pair of apertures disposed intermediate the length of said first section panel, said first section panel further including a pair of V-shaped grooves disposed at each of the opposed ends of said first section panel, and a second section panel hingedly connected to said first section panel of said cover flap and including chamfered corners;

a second outside panel of a second end wall having a tab extending from the bottom portion thereof and having a top portion panel pivotally connected to the top portion thereof, said top portion panels having a closure tab hingedly connected thereto;

a second side wall panel hingedly connected to the second outside panel of the second end wall and having an elongated flap extending from the bottom portion thereof, and a second cover flap extending from the top portion thereof, said second cover flap including a pair of apertures disposed intermediate the length of said second cover flap, said second side wall panel having an embossed depressed area therein adjacent to the top thereof;

an inner panel portion of the first end wall hingedly connected to said second side wall panel;

an inner panel portion of the first side wall hingedly connected to said inner panel of the first end wall;

a partition panel hingedly connected to said inner panel portion of the first side wall;

an inner panel portion of the second side wall hingedly connected to said partition panel; and an inner panel of the second end wall hingedly connected to said inner panel portion of the second side wall.

* * * * *